US006832842B2

(12) United States Patent
Sullivan

(10) Patent No.: US 6,832,842 B2
(45) Date of Patent: Dec. 21, 2004

(54) ORNAMENTAL ARTICLE

(76) Inventor: Christopher Sullivan, 47 East Rd., Atkinson, NH (US) 03811

( * ) Notice: Subject to any disclaimer, the term of this patent is extended or adjusted under 35 U.S.C. 154(b) by 0 days.

(21) Appl. No.: 10/295,561

(22) Filed: Nov. 15, 2002

(65) Prior Publication Data

US 2004/0095762 A1 May 20, 2004

(51) Int. Cl.[7] ..... F21V 3/00; F21V 5/00

(52) U.S. Cl. ..... 362/237; 362/251; 362/252; 362/806

(58) Field of Search ..... 362/565, 566, 362/121, 123, 350, 363, 806, 809, 520, 521, 249, 252, 237, 235, 251

(56) References Cited

U.S. PATENT DOCUMENTS

| | | | | | |
|---|---|---|---|---|---|
| 3,117,730 | A | * | 1/1964 | Jones | 362/235 |
| 4,259,709 | A | * | 3/1981 | Eddings | 362/231 |
| 6,070,991 | A | * | 6/2000 | Rumpel | 362/249 |
| 6,367,949 | B1 | * | 4/2002 | Pederson | 362/240 |

* cited by examiner

*Primary Examiner*—Alan Cariaso
*Assistant Examiner*—Guiyoung Lee
(74) *Attorney, Agent, or Firm*—Joseph Funk

(57) ABSTRACT

An ornamental article is disclosed that is spherical in shape and has a plurality of clear cups covering the surface of the sphere with their open end facing outward. The ornamental article has a plurality of lighting strings each with a plurality of lights, with a light from each string extending through the bottom of each of the cups. A control circuit energizes the lights of each of the plurality of lighting strings to produce different lighting patterns for the lights. The light is refracted through the clear material of the cups to enhance the ornamental quality of the ornamental assembly.

9 Claims, 4 Drawing Sheets

ORNAMENTAL ARTICLE

FIELD OF THE INVENTION

The present invention relates to an ornamental article used for decorative purposes and occasions, such as for use as Christmas or other holiday lighting decorations in the home, office, restaurants, etc., or for use as a lighting decoration in dance halls or similar places.

In addition, the present invention relates to an improved method for assembling a novel ornamental article of relatively large size for use as Christmas or other holiday decorations in the home, office, restaurants, etc., or for use as a lighting decoration in dance halls or similar places.

BACKGROUND OF THE INVENTION

Prior-known ornamental articles of relatively large size are known, such as round balls having a diameter of about 10 inches or more and having smooth or multi-bulbous or multifaceted surfaces. Such articles generally are hollow or of solid foam or other material and are formed of one piece construction or of two halves which are united to form the article. In some cases, such as multifaceted reflective ornaments, the ornamental outer surface is formed by adhering a plurality of polygonal mirror pieces to said surface.

Such prior-known ornamental articles generally are expensive, difficult to manufacture, cumbersome to store away, have a fixed, non-variable appearance and do not have parts which can be replaced easily if damaged.

U.S. Pat. No. 4,493,862 issued Jan. 15, 1985 to James Albert and Helen Allbert discloses an ornamental article having a supporting core which is a solid sphere, and a plurality of similar radially-extending decorative elements each having an attachment end securable to said core and a decorative end supported a fixed distance from said core. The decorative elements are hollow cones, the apex of which is attached to the solid core, and the axis of the cones extend radially from the solid core. A decorative colored ball is inserted into the open end of each cone distal from the core. The colored balls are conventional, round, Christmas tree ornaments having a diameter at least slightly larger than the open end of the cones.

As attractive as these prior art ornaments are they depend on reflecting light from external light sources to achieve much of their attractiveness, but this attractiveness is limited.

Thus, there is a need in the art for an improved ornamental article that is more attractive than prior art ornaments, and which does not rely on external devices to achieve its attractiveness.

SUMMARY OF THE INVENTION

The needs of the prior art are satisfied by the present invention. The present invention is an ornament that has a plurality of clear, cup shaped elements, their open ends facing outward. Behind, and extending through the base of each of the cups are lights that, when lit, the light is refracted through the cup shaped elements to create a dazzling effect. The lights may be white or colored.

The attractiveness of the present ornament is enhanced in that the lighting may be lit steadily, may be randomly pulsed, or may be pulsed in predetermined patterns.

DESCRIPTION OF THE DRAWINGS

The invention will be better understood on reading the following detailed description in conjunction with the drawing in which.

DETAILED DESCRIPTION

Figure 1:
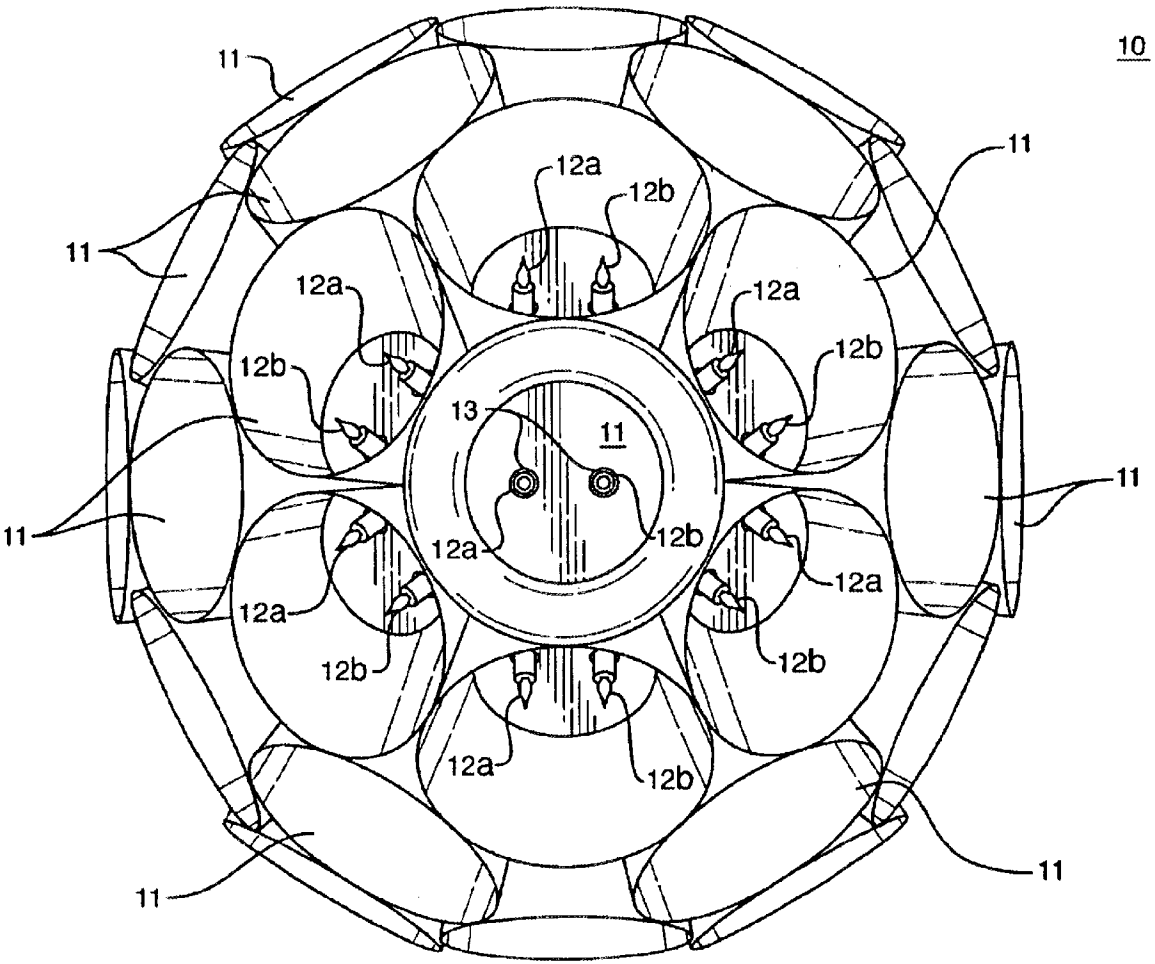
FIG. 1 shows a three dimensional view of my novel lighted ornament.

In FIG. 1 is shown a three dimensional view of a preferred embodiment of my novel lighted ornament. It is in the form of a lighted sphere 10. Sphere 10 is made up of a plurality of clear plastic, cup shaped members 11 that are adjacent to and fastened to each other and having their open ends racing outward. Only a portion of the cup shaped elements are designated with the element number 11 in FIG. 1 due to the large number of elements 11. In the remainder of the specification they are simply referred to as cups 11. The interior of sphere 10 is preferably hollow but a core support element may be provided to which the base of each of cups 11 are fastened.

The cups 11 preferably have walls that slope outward so that the diameter of the outer, open end is larger than the base. However, any shape cup may be used to implement the invention.

Through the base of each cup 11 are two holes 13, per the preferred embodiment of the invention. However, only one or more than two holes may be provided and utilized in the manner described hereinafter. In the hollow core of sphere 10 are located lights 13 and wiring therefore, such as strings of miniature lights used on Christmas trees. The light bulbs protrude through holes 13 from the hollow interior of sphere 10. Thus, a light bulb 12*a* of a first string of lights protrudes through one hole through the base of each cups 11, and a light bulb 12*b* of a second string of lights protrudes through the second hole through the base of each cups 11. With this configuration the light bulbs 12*a* and 12*b* in each of cups 11 may be easily replaced if they burn out or otherwise cease to function. Light bulbs 12*a* and 12*b* are lighted in different configurations as described hereinafter.

Cups 11 are preferably made of clear, polystyrene. Such cups may be obtained from the Solo Cup Company. As the lights 12*a* and 12*b* in each of cups 11 are lit, their emitted light passes directly out of the cups and through the walls of cups 11 and their adjacent cups. The emitted light is refracted through the walls of plastic of cups 11 and, to a viewer, sphere 10 appears to have more points of light than there are light bulbs 12*a* and 12*b*. In addition, there appears to be a myriad of points of light within the interior of sphere 10. Thus, an aesthetically pleasing appearance is provided.

Figure 2:
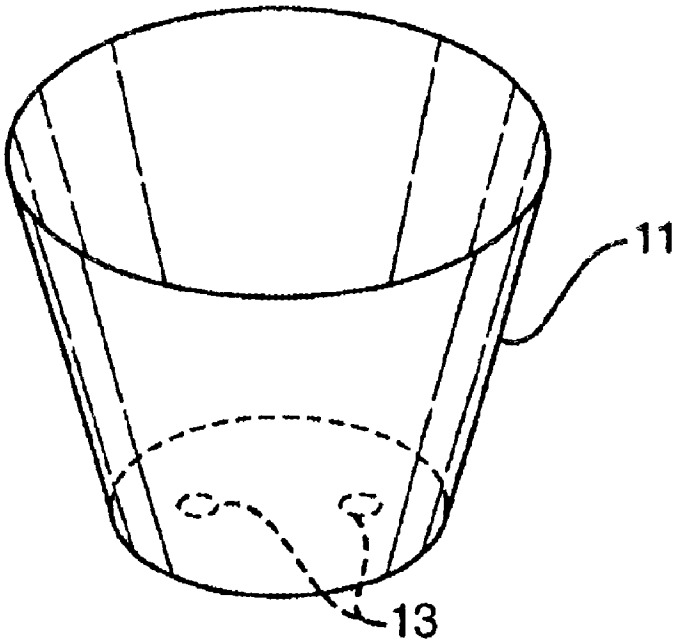
FIG. 2 shows a clear, cup shaped element used in my novel lighted ornament.

FIG. 2 shows one of the plurality of clear, cup shaped elements 11 used in my novel lighted ornament. As previously described, the diameter of the open top of each cup is larger than the diameter of the base of each cup. In addition, in FIG. 2 the walls of cup 11 are shown straight, but they be flared, opening toward the top of cup 11. Also shown are holes 13 through the base of cup 11 through which lights 12*a* and 12*b* protrude as seen in FIGS. 1 and 3.

Figure 3:
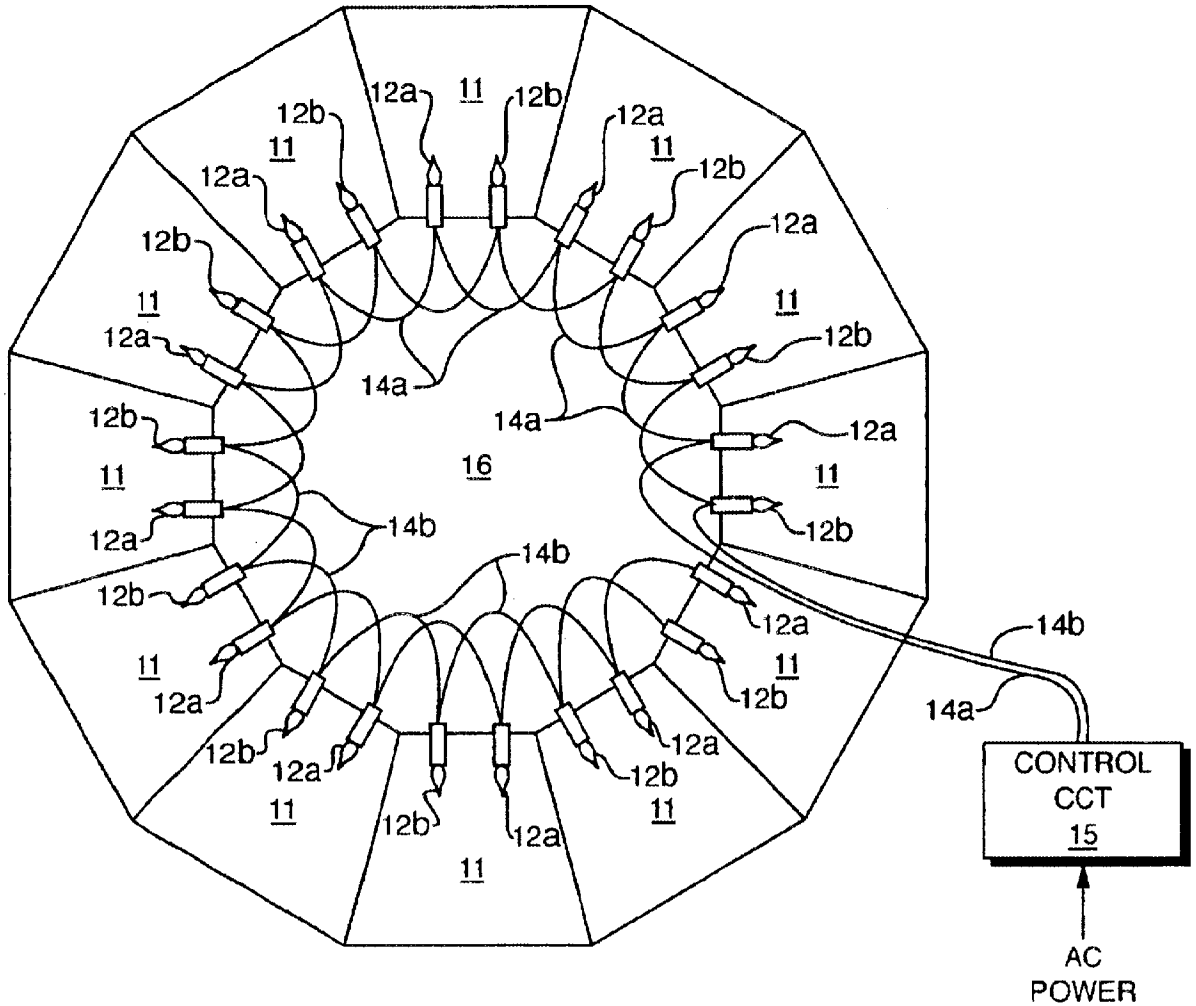
FIG. 3 shows a cutaway view of my novel lighted ornament showing the lights and their wiring to a control circuit.

FIG. 3 shows a mid section cutaway view of my novel lighted ornament 10. This view is in the form of a slice through the middle of sphere 10 so that other cups 11 and lights 12*a* and 12*b* further to the rear or to the front do not appear and clutter up the view. It can be seen that cups 11 are all adjacent to each other and a pair of lights 12*a* and 12*b* extend through the two holes 13 through the base of each cup 11.

It should be noted that in the preferred embodiment of the invention all lights 12*a* are all wired together, and all lights 12*b* are wired together. The set of lights 12*a* are all wired in parallel by wires 14*a*, and the set of lights 12*b* are all wired in parallel by wires 14*b*. Wires 14*a* and 14*b* are shown as a single wire for simplicity but they are really a pair of wires wired in a parallel manner well known in the art.

Thus, if any light bulb 12*a* or 12*b* burns out the other light bulbs 12*a* and 12*b* remain lit. The pair of wires 14*a* from lights 12*a*, and the pair of wires 14*b* from lights 12*b* pass external to sphere 10 to a lighting control circuit 15. Circuit 15 has alternating current power input to it from a standard 110VAC outlet.

Figure 4:
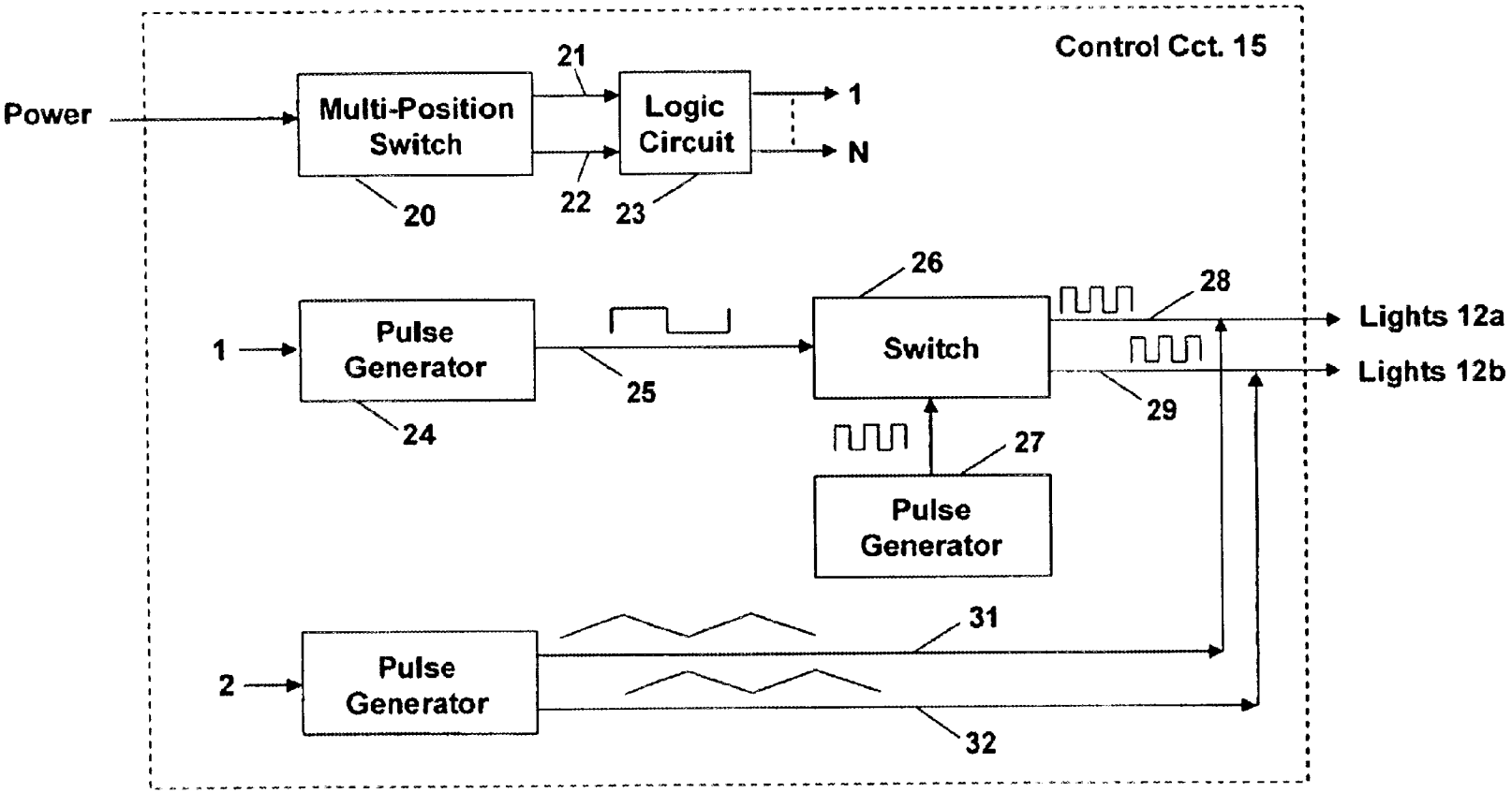
FIG. 4 shows a block diagram showing how the control circuit drives the lights of my novel lighted ornament.

FIG. 4 shows exemplary block diagrams of how control circuit 15 operates to illuminate lights 12*a* and 12*b* in various orders to provide aesthetically pleasing illumination. With two strings of lights, 12*a* and 12*b*, as signals of different waveforms and different frequencies are used to power different ones of the light sets, very pleasing lighting effects may be achieved. Control circuits that perform these functions are well known in the art and are commercially available. One such control circuit is Catalog No. YL-5K available from Sival, Inc. in Santa Clara, Calif. That product provides eight different combinations of lighting control variations for two strings of lights, including the two described below. Accordingly, the design and operation of such a control circuit is not part of the present invention.

Control circuit 15 has a multi-position switch that is used to manually select the mode of operation of lights 12*a* and 12*b*. FIG. 4 shows a representation for controlling lights 12*a* and 12*b* for two representative modes of lighting. Many other lighting modes are possible and are available in the commercially available control circuit identified in the previous paragraph. The exemplary circuit operation described herein is not necessarily the operation of the above mentioned commercially available control circuit.

When control circuit 15 in FIG. 4 has power applied to it there is an output on one of the leads of multi-position switch 20, as set by a user of my novel ornamental lighting article. The output on one of the leads from switch 20 cause an output to be provided from a logic circuit 23 on one of leads 1-N. The output from the logic circuit 23 causes various ones of gates, pulse and ramp generators and switches to be interconnected and energized. For the present examples, outputs from only leads 1 and 2 are described.

When there is an output from logic circuit 23 on lead 1, a pulse train from a pulse generator 24 is selected. One cycle of that pulse train is shown at the output of generator 24. The pulse train is input to a switch 26 that has two outputs, and on the positive half cycle of the pulses input to switch 26 there is an output from the switch on lead 28. On the negative half cycle of the pulses input to switch 26 there is an output from the switch on lead 29. There is a higher frequency pulse train from pulse generator 27 input to switch 26. The higher frequency is triple the frequency of the pulses output from pulse generator 24 as may seen in FIG. 4. Therefore, during the positive half cycle of the pulse train on lead 25, there are three pulses output from switch 26 on lead 28. During the negative half cycle of the pulse train on lead 25, there are three pulses output from switch 26 on lead 29. The pulses on lead 28 are applied to all lights 12*a*, and the pulses on lead 29 are applied to all lights 12*b*.

With this timing, all lights 12*a* blink three times, followed by all lights 12*b* blinking three times, and this cycle repeats until the setting of the multi-position switch 20 is changed, or until power is shut off. The pulse rate on leads 28 and 29 is three cycles per second. The visual effect of this alternate, rapid blinking of lights 12*a* and 12*b* is a twinkling effect that appears to dance around on the surface and from the inside of sphere 10.

When there is an output from logic circuit 23 on lead 2 signals from a ramp generator 30 are selected. The ramp waveforms are shown to the right of block 30. There are two outputs from ramp generator 30 on leads 31 and 32, and they have a one-hundred eighty degrees phase difference. The ramp waveform on lead 31 is applied to lights 12*a* and the ramp waveform on lead 32 is applied to lights 12*b*. The frequency of the ramp waveform is about one cycle per six seconds. The visual effect is that all lights 12*a* go from dark to being fully lit in about three seconds, and then lights 12*a* dim slowly back to dark over the next three seconds. At the same time, as lights 12*a* dim and go dark, lights 12*b* go from dark to being fully lit in three seconds. The visual effect is that the lighting appears to shift around on the surface and from the inside of sphere 10.

While two sets of lights 12*a* and 12*b* are shown and described, there may be more than two sets of lights. The limitation on the number of sets of lights that may be lit is determined only by the limitations of control circuit 15. In addition, while a sphere is disclosed for the preferred embodiment of the invention, other three-dimensional shapes may also be formed. For example, the shape may be a cube or a conical Christmas tree shape. Two-dimensional shapes may also be formed using the teaching of the invention. When a flat, two-dimensional display is formed, a hemispherical, conical or other shape clear cap may be placed on top of each cup to enhance the light being refracted through the clear plastic. Alternately, instead of a cap a clear plastic piece may be placed inside each cup to refract the light generated by the lights in each cup. Further, the clear plastic cups may be other than cylindrical, and they may be different sizes. The color of the light bulbs may also be different for the different sets of lights. Using all these variations many visual effects may be created, for many applications.

In addition, in an alternate embodiment of the invention a support core may be placed in the middle of any three-dimensional form of the invention to provide support for the cups and the strings of lights.

While what has been described herein is the preferred embodiment of the invention, it will be apparent to those skilled in the art that numerous changes may be made, such as described in the previous two paragraphs, without departing from the spirit and scope of the invention.

What is claimed is:

1. An ornamental assembly comprising; a plurality of cup like elements made from a clear material, the elements being fastened together to define an outer surface and a core of the ornamental assembly, each element having a plurality of holes through its bottom, a plurality of lighting strings each with a plurality of lights, with a light from each string extending through one hole in the bottom of each of the elements; means for energizing the lights of the plurality of lighting strings, the energizing means generating different energization pattern for the lights of each of the plurality of lighting strings; and wherein when the lights are illuminated by the energizing means their light is refracted through the clear material of the of cup like elements to enhance the ornamental quality of the ornamental assembly.

2. The ornamental assembly of claim 1 wherein the plurality of cup like elements made from a clear material are fastened together defining an outer surface and a core of the ornamental assembly, and the plurality of lighting strings are inside the core with their lights extending through the holes in the bottom of the cup like elements.

3. The ornamental assembly of claim 2 wherein the plurality of cup like elements fastened together substantially form a spherical shape.

4. The ornamental assembly of claim 3 further comprising a support element in the core of the ornamental assembly to support the cup like elements and the lighting strings.

5. The ornamental assembly of claim 4 wherein the cup like elements have an open end and the open end of all the elements face outwards on the ornamental assembly.

6. The ornamental assembly of claim 3 wherein a is core formed by the plurality of cup like elements fastened together is essentially hollow except for the lighting strings to better facilitate refracting light.

7. An ornamental assembly comprising:

a plurality of cup like elements made from a clear material and being fastened together to substantially form a spherical shape, with each of the plurality of the cup like elements have an open end that face outwards, and having at least one hole through their bottom;

a light extending through the at least one hole through the bottom of each of the plurality of cup like elements, the lights being illuminated and their light being refracted through the plurality of clear elements to enhance the ornamental quality of the ornamental assembly; and means for energizing the lights, the energizing means generating different energization pattern for the lights.

8. The ornamental assembly of claim 7 wherein there are a plurality of holes through the bottom of the plurality of cup like elements, and further comprising:

a plurality of lighting strings of which all the lights are part of, with a light from each string extending through one hole in the bottom of each of the elements; and means for energizing the lights of the plurality of lighting strings, the energizing means generating different energization pattern for the lights of each of the plurality of lighting strings.

9. The ornamental assembly of claim 8 further comprising a support element in the core of the ornamental assembly to support the cup like elements and the lighting strings.

* * * * *